US009505189B2

(12) United States Patent
Murray et al.

(10) Patent No.: US 9,505,189 B2
(45) Date of Patent: Nov. 29, 2016

(54) APPARATUS FOR FORMING A PLURALITY OF FLEXIBLE POUCHES FROM A CONTINUOUS WEB OF FILM

(75) Inventors: R. Charles Murray, Sarasota, FL (US); Olaf Clemens, Wipperfurth (DE)

(73) Assignees: SN Maschinenbau GmbH, Wipperfuerth (DE); Pouch Pac Innovations, LLC, Sarasota, FL (US)

( * ) Notice: Subject to any disclaimer, the term of this patent is extended or adjusted under 35 U.S.C. 154(b) by 838 days.

(21) Appl. No.: 13/471,010

(22) Filed: May 14, 2012

(65) Prior Publication Data

US 2012/0289389 A1 Nov. 15, 2012

Related U.S. Application Data

(60) Provisional application No. 61/485,537, filed on May 12, 2011.

(51) Int. Cl.

| | |
|---|---|
| ***B31B 1/10*** | (2006.01) |
| ***B31B 1/26*** | (2006.01) |
| ***B31B 1/64*** | (2006.01) |
| ***B31B 1/88*** | (2006.01) |

(Continued)

(52) U.S. Cl.

CPC ..... *B31B 1/00* (2013.01); *B31B 2219/022* (2013.01); *B31B 2219/2627* (2013.01); *B31B 2219/6053* (2013.01); *B31B 2219/88* (2013.01); *B31B 2219/9019* (2013.01); *B31B 2219/95* (2013.01); *B31B 2237/10* (2013.01); *B31B 2237/406* (2013.01)

(58) Field of Classification Search

CPC ..... B31B 1/10; B31B 1/26; B31B 1/90; B31B 2219/9019; B31B 2219/022; B65B 9/00; B65B 9/08; B65B 57/00; B65B 57/04; B65B 57/20; B65H 2301/4131; B65H 23/0208; B65H 23/192; B65H 23/044; B65H 23/046; B65H 23/10; B65H 23/12; B65H 23/18; B65H 23/105; B65H 23/1825; B65H 20/30; B65H 20/34; B65H 2408/211; B65H 2408/2171; B65H 2408/217; B65H 2408/212; B65H 2408/21; B65H 19/14; B29C 66/43

USPC ..... 493/11, 29, 188, 193, 214, 243, 244, 493/201, 180, 147, 235; 53/412, 562

See application file for complete search history.

(56) References Cited

U.S. PATENT DOCUMENTS 4,055,109 A * 10/1977 Kan ..... 493/196
4,129,238 A * 12/1978 Herd ..... B41F 13/025 101/181
4,313,781 A * 2/1982 Rovigo ..... B26F 3/06 156/269

(Continued)

*Primary Examiner* — Gloria R Weeks
*Assistant Examiner* — Justin Citrin
(74) *Attorney, Agent, or Firm* — Dinsmore & Shohl LLP

(57) ABSTRACT

An apparatus for forming a plurality of flexible pouches from a continuous web of film having a plurality of registration marks spaced a predetermined distance apart. The apparatus includes a film displacement mechanism, a registration mark sensor, and a controller. The film displacement mechanism includes at least one vertically oriented roller that rollingly engages with the continuous web of film. The film displacement mechanism adjusts the tension in the film by horizontally displacing the vertically oriented roller. The registration mark sensor is positioned upstream of the film displacement mechanism and is configured to detect the registration marks. The controller controls the film displacement mechanism to horizontally displace the film upon receipt of a signal from the registration mark sensor.

20 Claims, 5 Drawing Sheets

(51) Int. Cl.
*B31B 1/90* (2006.01)
*B31B 1/00* (2006.01)

(56) References Cited

U.S. PATENT DOCUMENTS 4,380,446 A * 4/1983 Dickson et al. ..... 493/11
4,944,502 A * 7/1990 Platzer ..... D01G 15/46
270/30.12
5,049,117 A * 9/1991 Mueller ..... 493/188
RE35,067 E 10/1995 Bauknecht
5,518,559 A 5/1996 Saindon et al.
5,777,879 A 7/1998 Sommerfeldt
5,833,107 A 11/1998 Terranova et al.
5,843,540 A 12/1998 Heydarpour et al.
6,024,683 A * 2/2000 Wilkes ..... B26D 1/626
493/196
6,067,778 A * 5/2000 Yamamoto et al. ..... 53/451
6,217,497 B1 * 4/2001 Laudenberg ..... 493/11
6,381,919 B2 * 5/2002 Todd et al. ..... 53/64
7,111,438 B2 * 9/2006 Arima ..... 53/399
8,122,687 B2 * 2/2012 Kinigakis et al. ..... 53/412
2002/0152719 A1 * 10/2002 Kinigakis et al. ..... 53/412
2005/0025394 A1 * 2/2005 Kinigakis et al. ..... 383/61.2
2009/0197750 A1 * 8/2009 Beckmann et al. ..... 493/11

* cited by examiner

APPARATUS FOR FORMING A PLURALITY OF FLEXIBLE POUCHES FROM A CONTINUOUS WEB OF FILM

CROSS-REFERENCE TO RELATED APPLICATIONS

This application claims priority of U.S. Provisional Patent Application Ser. No. 61/485,537 filed May 12, 2011, which is incorporated herein by reference in the entirety.

FIELD OF THE INVENTION

The invention relates to a machine for forming a flexible pouch, More particularly, the invention relates to a machine for forming flexible pouches from a roll of continuous web of film.

BACKGROUND OF THE INVENTION

It is well known in the art to provide flexible pouches with a reclosable closure such as a zipper type, press to seal, or slide fastener closure. The flexible pouches are typically formed from a roll of continuous web of flexible film that is sealed along the side edges prior to the separation of the flexible film into individual separate pouches. The flexible film is preprinted with images and text describing the product to be contained therein. As such, it is important that the flexible film be accurately positioned with respect to the side seals that delineate the film into separate pouches.

Moreover, as the side seals extending across height of the pouch, the side seals pass through opposite ends of the closure. However, as the side seals typically utilize heat, pressure, ultrasonic, or any combination thereof, the seals must extend through or melt the plastic closure in order to bond the side edges of the pouch. As the closure has a thickness substantially more than the thickness of the walls of the pouch panel and it is required that the entire plastic fastener be heated in order to melt the plastic so as to fuse together and form a non-leaking side edge, substantial heat and time is required.

It has been previously known to provide the closure with a plurality of apertures prior to the connection with the flexible film. An example of such an apparatus is disclosed in U.S. Pat. No. 5,906,438 issued May 25, 1999, which is herein incorporated by reference in the entirety. The apertures are spaced so as to be along the side edges where the seals will made in order to reduce the amount of mass of the closure at the side seal edges so that the time required to form the seal, the size of the seal across the closure at the side edges, and the occurrences of faulty seals will be reduced.

With respect to FIG. 5, a previously known apparatus for installing a closure A to a flexible film B is illustrated at C. The flexible film B is unwound from a roll D and drawn into a pouch formation machine (not shown). A length of the closure A is wound around reel E and passes through a punch device F that forms the apertures G in the closure A. However, the main disadvantage of the previously known system is that the length of closure A is pulled through the punch device F and unwound from the reel E by the force of formation machine drawing the flexible material B. As such, the length of closure A is often placed under tension which stretches the closure A as it passes through punch device F. Upon release of the tension on the length of closure A the apertures G become smaller due to the contraction of the closure A. The reduction in size of the apertures G leads to various pouch defects, including the misalignment of the seals on the apertures.

Further, during the formation process the flexible film has a tendency to stretch which distorts the images preprinted on the flexible film. In addition, the stretching of the film can potentially cause the images on the film to become misaligned with the sealing and separation station. If the images are not properly aligned with the sealing station and the separation station, the separated pouches will be defective as the placement of the images are disfigured.

Accordingly, there exists a need for an apparatus capable of accurately aligning the continuous web of film so that the images and apertures are properly placed with respect to the side seals by relieving the tension in the flexible film.

SUMMARY OF THE INVENTION

The present invention provides an apparatus for forming a flexible pouch from a continuous web of flexible film, which overcomes the above-mentioned disadvantages of the previously known machines by adjusting the tension in the film so as to accurately align the film as the film is sealed and separated.

In brief, the apparatus is provided for forming a plurality of flexible pouches from a continuous web of film having an interior surface, an opposite exterior surface, a plurality of registration marks spaced a predetermined distance apart. The apparatus includes a film displacement mechanism, a registration mark sensor, and a controller. The film displacement mechanism includes at least one vertically oriented roller that rollingly engages with the continuous web of film. The film displacement mechanism adjusts the tension in the film by horizontally displacing the vertically oriented roller.

The registration mark sensor is positioned upstream from the film displacement mechanism. The registration mark sensor is configured to detect one of the plurality of registration marks. The controller in communication with the film displacement mechanism and the registration mark sensor. The controller receives a signal from the registration mark sensor and controls the film displacement mechanism to adjust the tension in the film. The controller controls the web displacement mechanism to horizontally displace the film.

The apparatus optionally includes a film driver and a plow. The film driver feeds the continuous web of film into the apparatus. The plow is positioned between the film displacement mechanism and the web feeder. The plow contacts the continuous web of film to fold the film along a longitudinal axis so as to form a front panel and a rear panel in which the interior surface of the front panel faces the interior surface of the rear panel. The registration mark sensor is positioned downstream of the plow.

BRIEF DESCRIPTION OF THE DRAWINGS

Advantages of the present invention will be readily appreciated as the same becomes better understood by reference to the following detailed description when considered in conjunction with the accompanying drawings wherein.

DETAILED DESCRIPTION OF THE INVENTION

The present invention has utility as an apparatus for forming flexible pouches from a continuous web of flexible film, which compensates for the stretching of the film during pouch formation and closure insertion. By providing the apparatus with a film displacement mechanism, having at least one vertically oriented roller that horizontally displaces the film, the tension in the film can be reduced.

Figure 1:
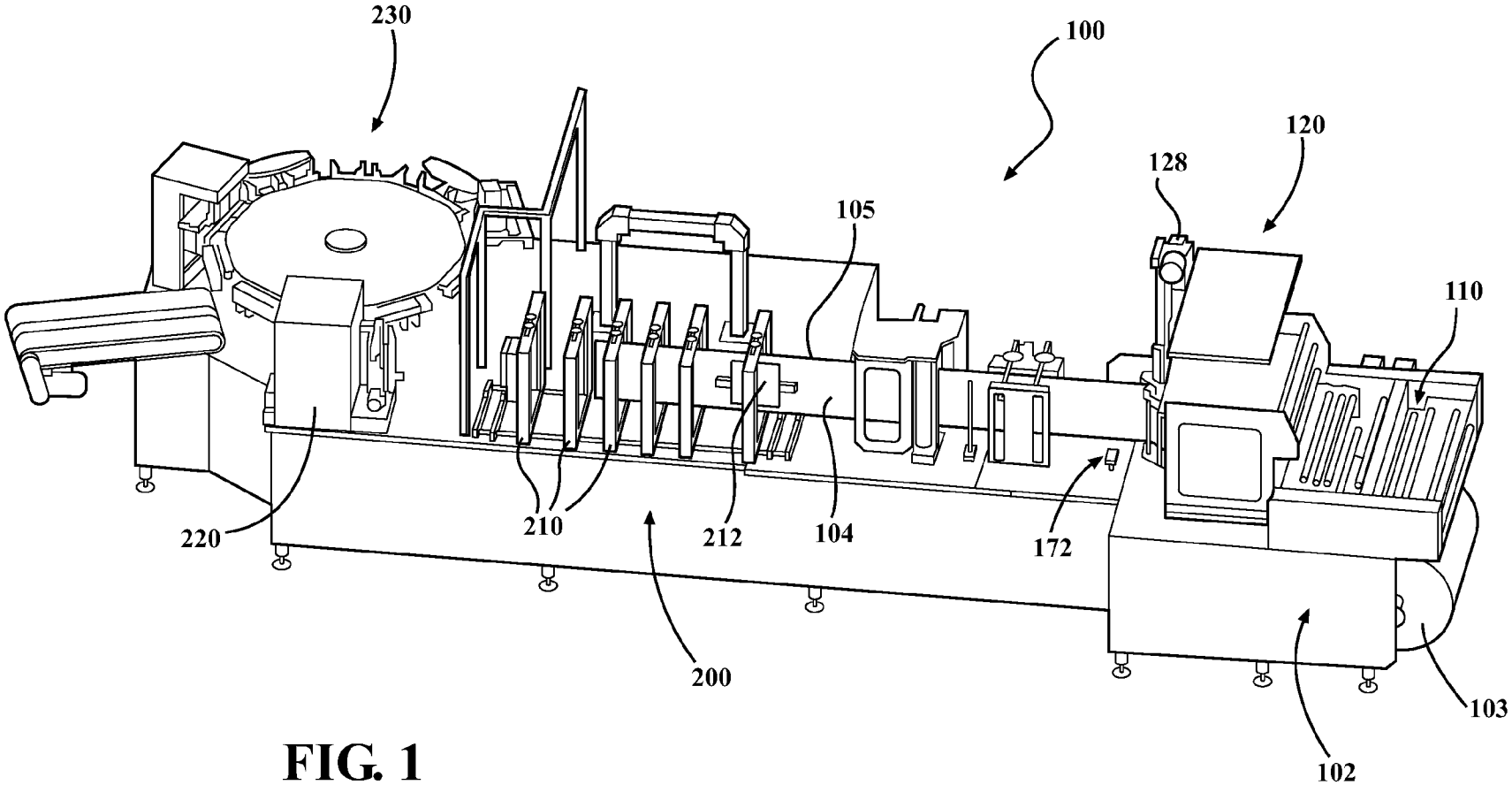
FIG. 1 is a perspective view of the inventive apparatus for forming flexible pouches form a continuous web of flexible film.

With reference to FIG. 1, an apparatus for forming a plurality of pouches is generally illustrated at 100. The apparatus 100 is particularly adapted for consumable products including edible dry products such as powders, chips, dog food, shredded cheese, or liquid products such as juice, carbonated beverages, and alcoholic beverages. However, it is appreciated, of course, that the apparatus 100 is not limited to consumable products.

Figure 2:
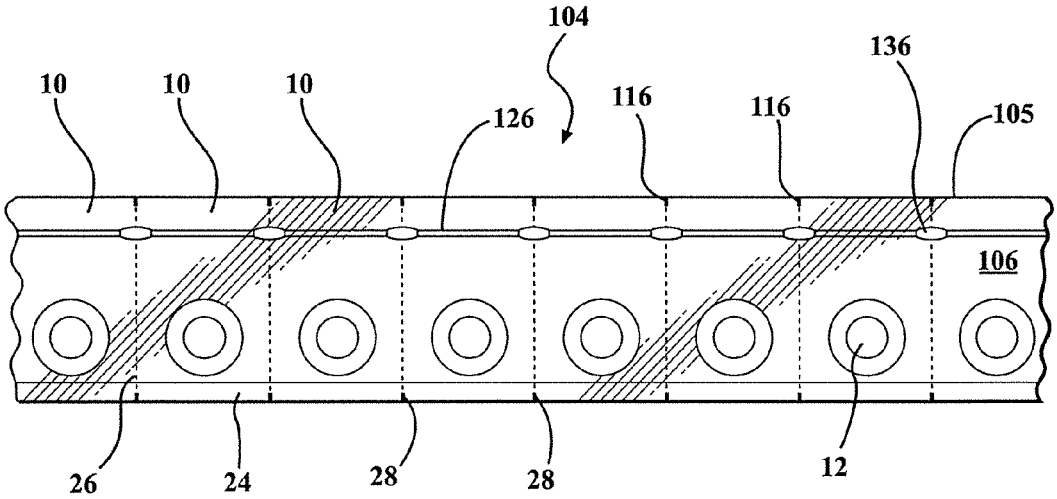
FIG. 2 is front view of the flexible film having the closure and the seals formed therein.
Figure 5:
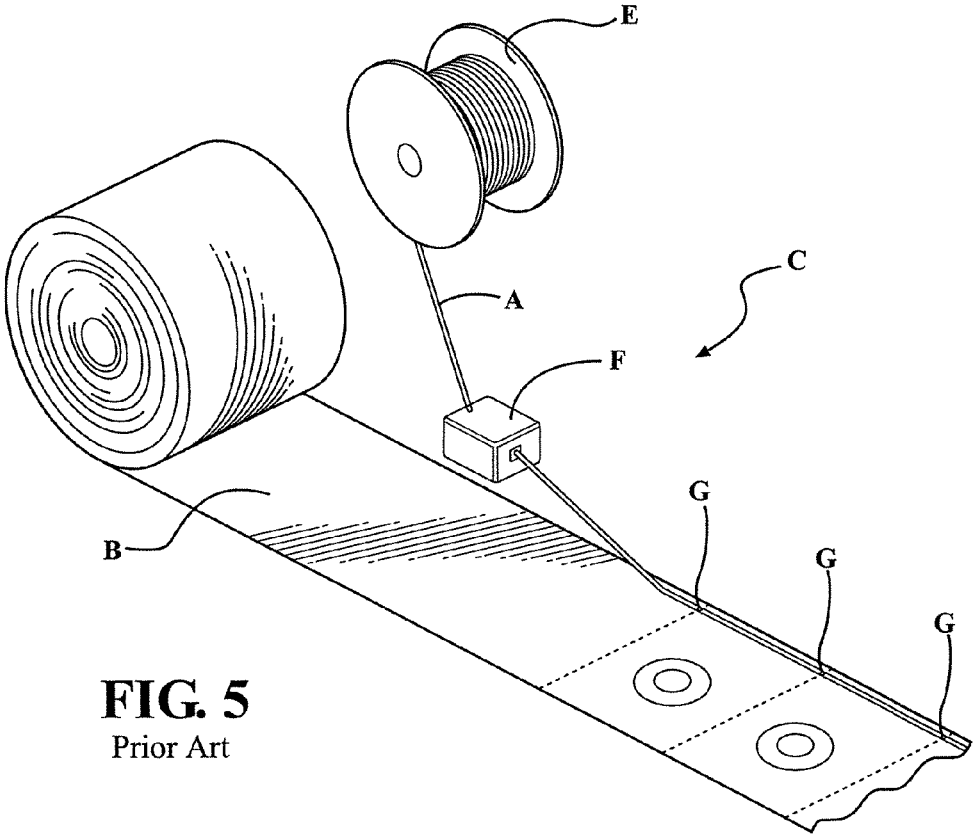
FIG. 5 Prior Art
FIG. 5 is a prior art view illustrating an apparatus for forming closure apertures and attaching the closure to a flexible material.

The apparatus 100 includes a web driver 102 that feeds a roll 103 of a continuous web of flexible film material 104 that forms the pouch 10, best seen in FIG. 2. The film 104 is preferably formed from a roll of preprinted material of extruded or laminate layers. The film 104 is typically a three, or four, or five or more gauge material or multiple laminations of material or the like. The film 104 includes side edges 105, an exterior surface 106 and an opposite interior surface 108, as best seen in FIG. 3.

With reference to FIG. 2, the exterior surface 106 is typically preprinted with information such as a label 12, images and text that defines the product to be contained within the pouch 10. Alternatively, at least a portion of the film 104 may be not printed, i.e. translucent, in order to view the contents contained therein. The translucent portion is optionally formed as an insert. The film 104 is optionally formed of more than one type of material. The choice of sheet layer material is non-limiting, and is influenced by factors such as the product contained in the pouch 10, the shape of the pouch 10, or the anticipated use of the pouch 10.

The apparatus 100 includes a dancer system 110 positioned downstream of the web driver 102. The dancer system 110 accumulates the film 104 feed by the film driver 102, and maintains a constant tension on the film 104 until a secondary driver 112 drives the film 104 forward. The dancer system 110 permits the apparatus 100 to run intermittently.

After exiting the dancer system 110, the film 104 passes through a punch hole device 114, such as disclosed in U.S. Pat. No. 6,217,497 issued Apr. 17, 2001, which is herein incorporated by reference in the entirety. The hole punch device 114 includes a sensor 118 that detects a plurality of registration marks 116 formed on the film 104. The sensor 118 senses registration mark 116 and issues a signal for the hole punch device 114 to punch a pair of holes 107 into the film 104. The holes 107 allow for heat from the heat sealers, described in greater detail below to pass through the holes 107 and seal the bottom portion of the pouch 10.

The plurality of registration marks 116 are spaced a predetermined distance apart on an edge 105 of the film 104. The registration marks 116 are spaced apart by a distance of one pitch P, which is equivalent to a width of the pouch 10. The registration marks 116 are a printed or imbedded into the exterior surface 106, the interior surface 108 or on both sides of the film 104. As best seen in FIG. 2, the registration mark 116 is placed to indicate a side edge line 26 which along which the web 104 is sealed and cut to separate continuous web of film 104 into individual pouches 10.

The secondary driver 112, positioned downstream from the hole punch device 114, drives the film 104 into a folding and closure insertion section 120. In folding and closure insertion section 120, the previously horizontally oriented film 104 is folded by a plow 122 provided in the path of the film 104. The plow 122 folds the film along a longitudinal axis L1 so as to form a front panel 14 and a rear panel 16, as best seen in FIG. 2. The plow 122 folds the film 104 from a single thickness horizontally extending orientation to a vertically extending thickness orientation thereby providing the film 104 with the front panel 14 and a rear panel 16 which form the front and rear panels of the pouch 10.

Figure 4:
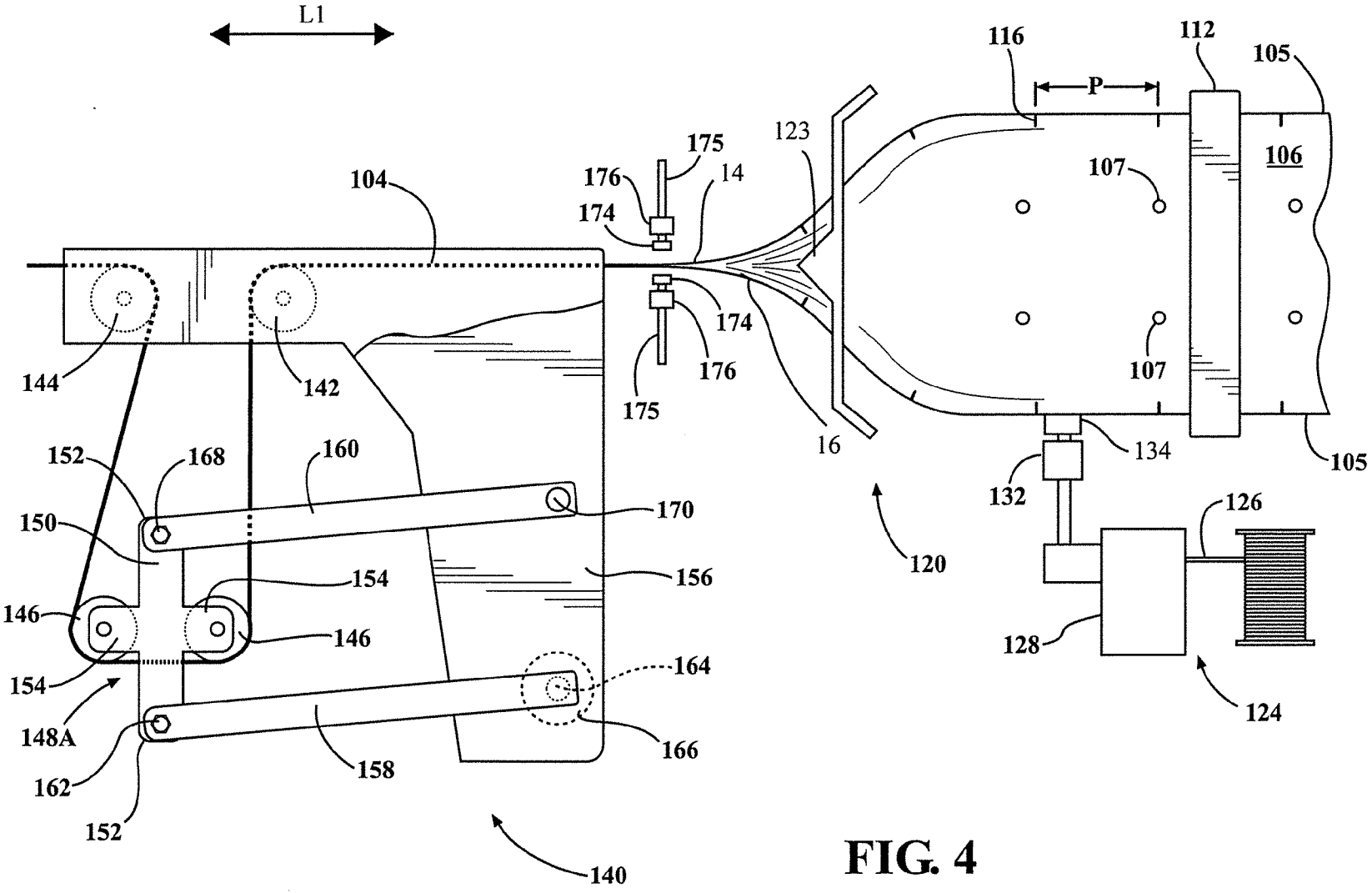
FIG. 4 is a bottom schematic view of the pouch forming apparatus.

Specifically, the film 104 is drawn over the plow 122 which is in contact with the interior surface 108 of the film 104. In addition, the plow 122 includes a gusset forming portion 123 provided underneath the film 104, as best seen in FIG. 4, so as to contact and push the exterior surface 106 upward and between the front panel 14 and the rear panel 16 thereby forming a gusset 24. The holes 107 formed by the hole punch device 114 are provided in the portion of the film 104 that forms the gusset 24, which is the bottom portion of the pouch 10 positioned between the front panel 14 and the rear panel 16, so as to improve the sealing efficiency of the gusset 24.

The folding and closure insertion section 120 further includes a closure installation device 124 that inserts a continuous strand of a reclosable closure 126 between the front panel 14 and the rear panel 16 of the pouch 10. Specifically, the closure 126 is placed between the interior surface 108 of the folded film 104 a predetermined distance from the edges 105 of the film 104, as best seen in FIG. 2. The reclosable closure 126 is optionally a zipper like fastener having a pair of bands in which one band is secured to the interior surface 108 of the front panel 14 and the other band is secured to the interior surface 108 of the rear panel 16. The bands are held together by an outwardly extending tongue formed in one of the bands and a cooperative groove formed in the other band, such as disclosed in U.S. Pat. No. 5,906,438, issued May 25, 2009.

The closure installation device 124 includes a closure feed device 128 which unwinds a length of the zipper fastener 10 from a roll 130. The closure feed device 128 includes an electronically controlled servo motor that feeds the closure 126 through the closure installation device 124. A plurality 132 of rollers defines a closure path that the closure 126 follows from the roll 130 into the film 104. The closure feed device 128, specifically the motor, operates to unwind a length of closure 126 from the roll 130 and feed the closure 126 through the closure installation device 124. Accordingly, the closure 126 is fed by the closure feed device 128 rather than pulled through the closure installation device 124 and into the flexible film 104. The rollers 132 in conjunction with the motor of the closure installation device 126 are configured so as to gently draw out the closure 126 form the roll 130 thereby reducing any slack in the closure installation device 124.

The closure installation device 124 also includes a punch device 134 which forms apertures 136 in the closure 126 prior to the closure 126 being inserted into the film 104. As best seen in FIGS. 3 and 4, the punch device 134 is positioned between a pair of rollers 132 which reduces any tension in the closure 126 so as to precisely form apertures 136 within the closure 126. As the closure 126 is not being pulled by the force of the film 104 being feed through the apparatus 100, the apertures 136 retain the appropriate size even after leaving the closure installation device 124.

As disclosed in U.S. Pat. No. 5,906,438 issued May 25, 1999, apertures 136 in the continuous stand of closure 126 are provided in order to reduce the amount of plastic material present at the side edge lines 26 of separation in order to reduce the occurrence of a bulbous mass upon separation of the panels into individual pouches 10. The closure insertion device 124 secures the closure 126 to the interior surfaces 108 of the front panel 14 and the rear panel 106 through the operation of heat, pressure, adhesive, ultrasonics, or any combination thereof. It is appreciated, of course, that the means for attaching the closure 126 to the interior surfaces 108 of the front panel 14 and the rear panel 16 at a predetermined distance from the edge 105 of the film 104 is not limited in the methods described thereof.

The apparatus 100 further includes a controller 138 having memory and a processor which is used to control the operation of the apparatus 100, and at least one registration mark sensor 145, which detect the registration marks 116 on the film 104 that is connected to the controller 138. The registration mark sensor 145 is provided downstream of the folding and closure insertion section 120 so as to detect the registration marks 116 the distance between may have varied due to the stress of the folding and closure insertion section 120. The registration mark sensor 145 is optionally a plurality of sensors, and is an optical sensor, bar reader, data matrix reader, or the like which is operable to sense/detect the registration mark 116.

The operation of the closure feed device 124 and hole punch 132 and punch hole device 114 is controlled by the controller 138. The controller 138 receives a signal from a sensor positioned adjacent to the folding and closure insertion section 120 and actuates the servo motor of the closure feed device 128 to advance the feed of a predetermined length of the closure 126 through the closure installation device 124 including the punch device 134. The sensor is optionally a registration mark sensor 145 discussed below.

As the apparatus 100 advances the film 104 through the pouch formation process intermediately, the closure feed device 128 in coordination advances only the required amount of the closure 126 into the intermediately advancing film 104. The closure feed device 128 reduces the stress on the film 104, as the film 104 is no longer required to bear the stress of unwinding the closure 126 from the roll 130 and pulling the closure 126 through punch device 134, thus allowing the closure installation device 124 to be used on thinner gauged continuous webs if films formed of thinner gauged flexible material that would have ripped or torn if required to bear the stress of pulling the closure 126.

Figure 3A:
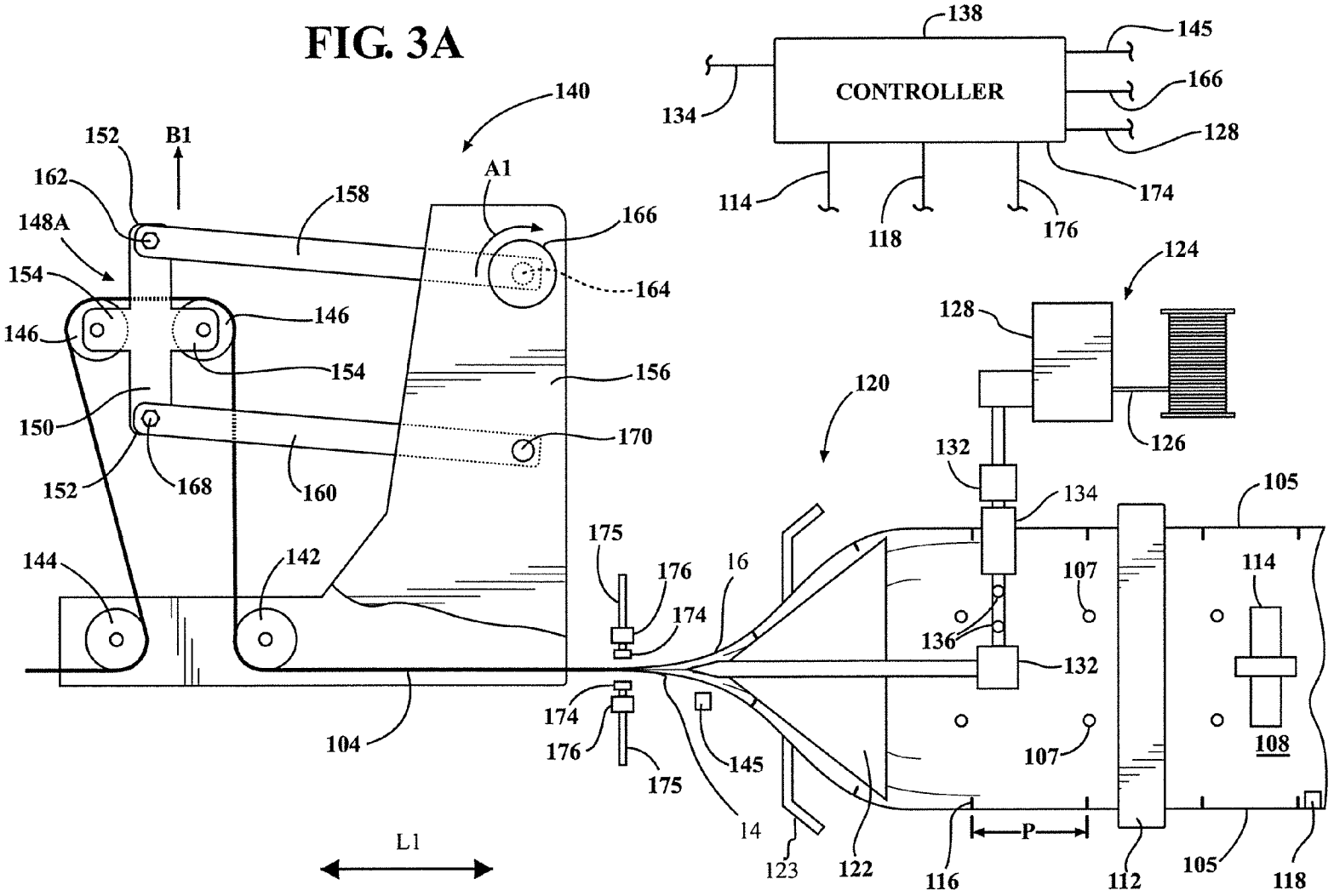
FIG. 3A is a top schematic view of the pouch forming apparatus with the film displacement mechanism in the initial position.
Figure 3B:
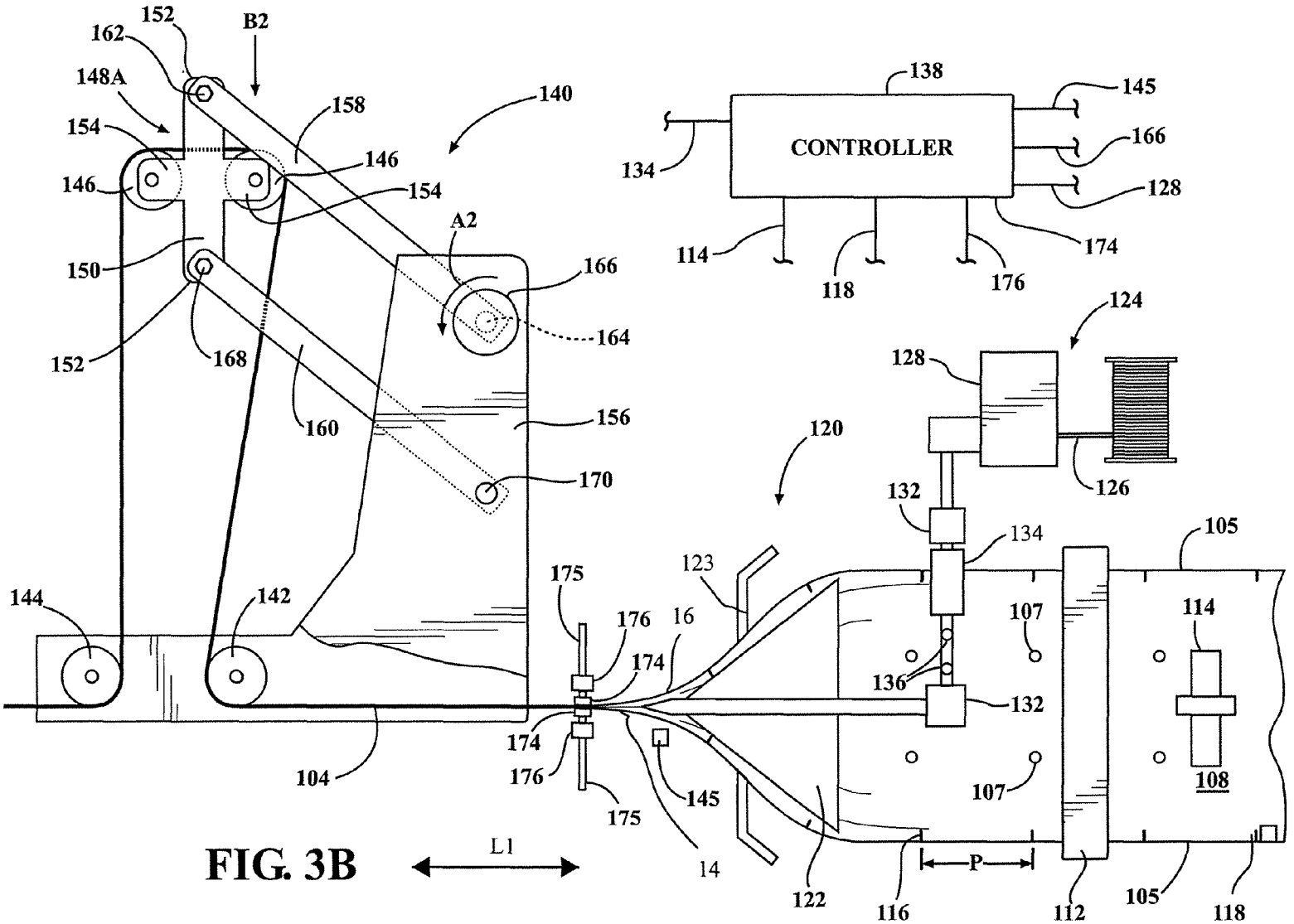
FIG. 3B is a top view of the pouch forming apparatus with the displacement mechanism in the displaced position.

Positioned at least one pitch P downstream from the registration mark sensor 145 is a gusset seal station 172. The gusset seal station 172 is controlled by the controller 138 based on a signal from the registration mark sensor 145. The gusset seal station 172 includes a pair of seal bars 174 positioned on either side of the film 104. Each of the pair of seal bars 174 is provided on a rod 175 attached to an actuation member 176 which are controlled by the controller 138. The actuation member 176 moves the rod 175 and the seal bars 174 between a first position and a second position. As best seen in FIGS. 3A and 4, the seal bars 174 are spaced apart from the film 104 in the first position, and as seen in FIG. 3B the seal bars 174 are in contact with the film in the second position. In the second position, the seal bars 174 tack seal the gusset 24 to the front panel 14 and the rear panel 16 of the film to provide a preliminary seal 28 to hold the gusset 24 during the remaining pouch forming operation, including the horizontal displacement of the film 104 described in greater detail below, prior to the gusset 24 receiving a permanent seal at the sealing station 200.

In operation, a registration mark 116 on the film 104 is detected by the registration mark sensor 145 and a signal indicating such is sent to the controller 138. As the seal bars 174 are positioned at least one pitch P downstream of the registration mark sensor 145, the controller 138 actuates the actuation members 176 to move the seal bars 174 from the first position to the second position to provide a preliminary seal 28 at the correct position where the holes 107 are formed on the film 104.

The preliminary seal 28 prevents the portion of the film 104 that forms the gusset 24 from dropping down between the front panel 14 and the rear panel 16 during pouch formation. At the seal station 200, the preliminary seal 28 will be fully sealed. The seal bars 174 use heat, ultrasonics, pressure or a combination thereof to preliminary seal the gusset 24 in place.

The seal bars 174 are positioned so as to align with the holes 107 formed by the hole punch device 114. The holes 107 allow for the interior surfaces 108 of the front panel 14 and the rear panel 16 to contact the gussets 24 which is the portion of the film 104 tucked between the front panel 14 and the rear panel 16. The holes 107 allow for a quicker sealing as the seal bars 174, and those of the seal station 200, are not required to melt through two layers of the film 104 that forms the gusset 24 to result in a standup type pouch 10 which is formed of a flexible material. Heat, pressure, ultrasonics, or any combination thereof from the seal bars 174, and the sealing bars of the sealing station 200, can quickly to pass through the holes 107 and seal the gusset 24 to form the stand up pouch 10.

After the closure 126 has been securely attached to the interior surfaces 108 of the film 104 by the closure installation device 124, and the gusset 24 receives the preliminary seal 28, the folded film 104 passes through a film displacement mechanism 140. The film displacement mechanism 140 is connected to and controlled by the controller 138.

The film displacement mechanism 140 includes an entrance guide roller 142 that guides the film 104 into the film displacement mechanism 140, and an exit guide roller 144 that guides the film out of the film displacement mechanism 140. The film displacement mechanism 140 includes a pair of vertically oriented rollers 146 that are in rollingly engagement with the film 104. As best seen in FIGS. 3A, 3B, and 4, the ends of each of the pair of vertically oriented rollers 146 are rotatably attached between an upper roller support members 148A and a bottom roller support member 148B. Each of the upper roller support member 148A and the lower roller support member 148B include an elongated portion 150 having a pair of ends 152. A pair of arms 154 extend from opposite sides of the elongated portion 150 between the pair of ends 152 so as to provide each of the roller support members 148A and 148B with a generally X or cross shape. The top ends of the pair of rollers 148 are rotatably attached to the arms 154 of the upper roller support member 148A and the bottom ends of the pair of rollers 148 are rotatably attached to the arms 154 of the lower roller support member 148B.

Each of the upper and lower roller support members 148A and 148B are connected to a frame or base portion 156 by a drive rod 158 and a driven rod 160. Each of the drive rods 158 includes a distal end 162 and a proximate end 164. The distal ends 162 of the drive rods 158 are pivotally connected to one of the ends 152 of each of the roller support members 148A and 148B and the proximate ends 164 of the drive rods 158 are secured to a rotating device 166 attached to the frame portion 156. Each of the driven rods 160 includes a distal end 168 and a proximate end 170. The distal ends 168 of the driven rods 160 are pivotally connected to one of the ends 152 of each of the roller support members 148A and 148B and the proximate ends 170 of the driven rods 160 are pivotally mounted to the frame portion 156. The drive rods 158 and the driven rods 160 acts as a connection member between the upper and lower roller support members 148A and 148B and the frame portion 156. A shaft connects the proximate ends 166 of both drive rods 158 to the rotating device 166.

After exiting the plow 122 and being folded from a horizontally oriented single thickness position to a vertically oriented double thickness, with a gusset 24, position, the film 104 is traveling at an elevated speed and therefore under tension. The speed and the tension could cause the film 104 to enter the sealing station 200 in an unaligned manner thereby causing defects in the sealing operation. In order remove the tension in the film 104, the film displacement mechanism 140 horizontally displaces the film 104 so as to reduce the elevated speed to a reduced speed that is slower than the elevated speed. The reduction in the travel speed of the film 104 after traveling through the film displacement mechanism 140 reduces the tension in the film 104.

Specifically, as the film 104 exits the folding and closure insertion section 120, the registration mark sensor 145 detects the registration mark 116 provided on the edge 105 of the film 104. The registration mark sensor 145 sends a signal to the controller 138 which actuates the film displacement mechanism 140 to horizontally displace the film 104. The controller 138 controls the rotating device 166 to rotate in the direction of arrow Al thereby driving the drive rod 158 to horizontally displace the pair of rollers 146 in the direction of arrow B1, as best seen in FIG. 3A. The controller 138 then actuates the rotating device 166 to rotate in the direction of arrow A2 thereby driving the drive rod 158 to return the horizontally displaced pair of rollers 146 in the direction of arrow B2, as best seen in FIG. 3B.

The horizontal displacement of the film 104 by the film displacement mechanism 140 increases the length of the path that the film 104 must travel thereby reducing the film speed from the elevated speed exiting the folding and closure insertion section 120 to the reduced speed after exiting the film displacement mechanism 140. The reduction in speed and horizontal displacement provides a very low film pulling force which reduces the tension in the film 104 and provides a more precise film feed through the apparatus.

The rotating device 166 includes a servo motor that is electronically controlled by the controller 138 for rotation in the directions of arrows A1 and A2. In the alternative, the rotating device 166 includes a cam actuated reciprocating mechanism that is mechanically controlled or electronically controlled by the controller 138 and which rotates in the direction of arrows A1 and A2. The alternative rotating device further includes a biasing member to biasing the rotating device 166 in the direction of either arrows A1 or A2.

After the film 104 exits the film displacement mechanism 140, at the reduced speed which is lower than the elevated speed that the film 104 had entering the film displacement mechanism 140, the film 104 enters into the sealing station 200, as best seen in FIG. 1. The sealing station 200 includes a plurality of sealing bars 210 that are actuated to form seals along the registration marks 116 to provide the sealed edges 26 of the pouches 10. In addition, the sealing bars 210 provide a secondary seal the gusset 24 to finally seal the preliminary seal 28. The sealing bars 210 provide the secondary seal along the side edge lines 26 and over the preliminary gusset seal 28. The sealing bars 210 are individually adjustable in the longitudinal direction of the film 104. A sensor 212 senses the registration mark 116 and the controller 138 upon receiving the signal from the sensor 212 actuates sealing bars 210.

Once the film 104 has received the sealed edges 26 at the sealing station 200, the film 104 travels to a separation station 220 that separates the film 104 into individual pouches 104 by cutting the film 104 along the sealed edges 26. After being separated the individual pouches 10 are transferred into a fill-seal machine 230 or packaged for storage. In the illustrated embodiment, the apparatus 100 is formed together with a rotary fill-seal machine 230; however, the apparatus is not limited to such a configuration. Specifically, the fill-seal machine 230 is optionally connected to or separate from the apparatus, and is optionally a linear fill-seal machine.

It is appreciated, of course, that the various registration mark sensors 118 and 145 are optionally a single sensor positioned either downstream of the plow 122 or upstream of the hole punch device 114.

Having described the invention, however, many modifications thereto will become apparent to those skilled in the art to which it pertains without deviation from the spirit of the invention as defined by the scope of the appended claims.

It is claimed:

1. An apparatus for forming a plurality of flexible pouches from a continuous web of film having an interior surface, an opposite exterior surface, and a plurality of registration marks spaced a predetermined distance apart, said apparatus comprising:

a film displacement mechanism having a pair of vertically oriented rollers that rollingly engage with the film, a base member, a first rod, a roller support member, and a motor attached to said base member, said pair of vertically oriented rollers are rotatably attached to said roller support member, said first rod having a proximate end and a distal end, said proximate end of said first rod is secured to said motor and said distal end of said first rod is pivotally attached to said roller support member, said motor rotates in a first direction and a second direction, opposite said first direction, to adjust the tension in the film by horizontally displacing said pair of vertically oriented rollers;

a registration mark sensor positioned upstream of said film displacement mechanism, said registration mark sensor configured to detect one of the plurality of registration marks; and a controller receives a signal from said registration mark sensor and said controller controls said motor to rotate so as to horizontally displace the film based on said signal from said registration mark sensor.

2. The apparatus of claim 1 further comprising:

a feeder that feeds the web of film into said apparatus; and a plow positioned between said feeder and said film displacement mechanism, said plow positioned so as to fold the film along a longitudinal axis to form a front panel and a rear panel, and wherein the interior surface of the front panel faces the interior surface of the rear panel.

3. The apparatus of claim 2, wherein said registration mark sensor is positioned downstream of said plow.

4. The apparatus of claim 3 further comprising:

a closure insertion device positioned upstream of said plow and downstream of said feeder, said closure insertion device inserting a continuous strand of a closure between the front panel and the rear panel as the film is folded by said plow.

5. The apparatus of claim 4, wherein said closure insertion device includes an electronically controlled feeder mechanism that incrementally feeds the continuous strand of closure between the front panel and the rear panel of the film.

6. The apparatus of claim 2, wherein a gusset formation member is provide underneath said plow such that the film is between said plow and said gusset formation member, wherein said gusset formation member contacts the exterior surface of the film to guide a portion of the film upwardly between the front panel and the rear panel to form a gusset in the pouch.

7. The apparatus of claim 6, wherein each pouch has a predetermined panel width of one pitch, and wherein the predetermined distance that the registration marks are provide is equal to one pitch.

8. The apparatus of claim 7, further comprising:

a preliminary gusset seal station positioned at least one pitch downstream from said registration mark sensor, said preliminary gusset seal station having a pair of opposing seal bars positioned on either side of the film, said controller controls said preliminary gusset seal station to provide a preliminary seal on the gusset of the film upon receiving a signal from said registration mark sensor; and a seal station positioned downstream from said film displacement mechanism, said seal station forming a side seal to separate the film into individual pouches sealing the film, said side seal extending over said preliminary seal on the gusset.

9. The apparatus of claim 8 , wherein the seal station forms a plurality of linear seals onto the film.

10. The apparatus of claim 9, wherein said film displacement mechanism includes a first vertically oriented roller and a second vertically oriented roller, said first vertically oriented roller is positioned upstream of said pair of vertically oriented rollers, said second vertically oriented roller is positioned downstream of said pair of vertically oriented rollers and said first vertically oriented roller, wherein horizontal displacement of said pair of vertically oriented rollers to increase the tension in the film increases a distance between said pair of vertically oriented rollers and said first vertically oriented roller and said second vertically oriented roller.

11. The apparatus of claim 1, wherein the film enters said film displacement mechanism at a first speed, and wherein the horizontal displacement of said pair of vertically oriented rollers in a first direction increases a distance that the film travels such that the film exits said film displacement mechanism at a second speed which is lower than said first speed.

12. The apparatus of claim 1 further comprising a second rod having a proximate end and a distal end, wherein said proximate end of said second rod is pivotally attached to said base member and said distal end of said second rod is pivotally attached to said roller support member.

13. The apparatus of claim 12, wherein said roller support member has an elongated portion and a pair of arm portions extending from opposite sides of said elongated portion, wherein said distal end of said first rod is pivotally connected to one end of said elongated portion, said distal end of said second rod is pivotally connected to an opposite end of said elongated portion, and wherein each of said pair of vertically oriented rollers is rotatably attached to one of said pair of arm portions.

14. The apparatus of claim 1, wherein said motor is a servo motor.

15. An apparatus for forming a plurality of flexible pouches from a continuous web of film having an interior surface, an opposite exterior surface, and a plurality of registration marks spaced a predetermined distance apart, said apparatus comprising:

a film displacement mechanism having a pair of vertically oriented rollers, the film extends directly from one of said pair of vertically oriented rollers to said other of said pair of vertically oriented rollers, said film displacement mechanism adjusts the tension in the film by horizontally displacing said pair of vertically oriented rollers;

a registration mark sensor positioned upstream of said film displacement mechanism, said registration mark sensor configured to detect one of the plurality of registration marks; and a controller receives a signal from said registration mark sensor and said controller controls said film displacement mechanism to horizontally displace the film based on said signal from said registration mark sensor.

16. The apparatus of claim 15 further comprising:

a feeder that feeds the web of film into said apparatus; and a plow positioned between said feeder and said film displacement mechanism, said plow positioned so as to fold the film along a longitudinal axis to form a front panel and a rear panel, and wherein the interior surface of the front panel faces the interior surface of the rear panel.

17. The apparatus of claim 16, wherein said registration mark sensor is positioned downstream of said plow.

18. The apparatus of claim 17 further comprising:

a closure insertion device positioned upstream of said plow and downstream of said feeder, said closure insertion device inserting a continuous strand of a closure between the front panel and the rear panel as the film is folded by said plow.

19. The apparatus of claim 18, wherein said closure insertion device includes an electronically controlled feeder mechanism that incrementally feeds the continuous strand of closure between the front panel and the rear panel of the film.

20. An apparatus for forming a plurality of flexible pouches from a continuous web of film having an interior surface, an opposite exterior surface, and a plurality of registration marks spaced a predetermined distance apart, said apparatus comprising:

a film displacement mechanism having a pair of vertically oriented rollers, a rotating device, a base member, a connection member and a roller support member, said pair of vertically oriented rollers rollingly engage with the film, said pair of vertically oriented rollers are rotatably attached to said roller support member, said rotating device is attached to said base member, said roller support member has an elongated portion and a pair of arm portions extending from opposite sides of said elongated portion, each of said pair of vertically oriented rollers is rotatably attached to one of said pair of arm portions, said connection member is a first rod and a second rod, each of said first rod and said second rod having a proximate end and a distal end, said proximate end of said first rod is secured to said rotating device, said distal end of said first rod is pivotally connected to one end of said elongated portion of said roller support member, said proximate end of said second rod is pivotally attached to said base member, said distal end of said second rod is pivotally connected to an opposite end of said elongated portion of said roller support member, a registration mark sensor positioned upstream of said film displacement mechanism, said registration mark sensor configured to detect one of the plurality of registration marks; and a controller receives a signal from said registration mark sensor and said controller controls said rotating device to rotate to horizontally displace said pair of vertically oriented rollers to adjust the tension in the film such that the film enters said film displacement mechanism at a first speed and the horizontally displacement of said pair of vertically oriented rollers in a first direction increases a distance that the film travels such that the film exits said film displacement mechanism at a second speed which is lower than said first speed.

* * * * *